US008199089B2

(12) United States Patent
Lin et al.

(10) Patent No.: US 8,199,089 B2
(45) Date of Patent: Jun. 12, 2012

(54) DEVICE FOR TUNING OUTPUT ENABLE SIGNAL OF LIQUID CRYSTAL DISPLAY

(75) Inventors: Shu-Yang Lin, Yunlin County (TW); Yu-An Liu, Yunlin County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 423 days.

(21) Appl. No.: 12/485,891

(22) Filed: Jun. 16, 2009

(65) Prior Publication Data

US 2010/0245317 A1 Sep. 30, 2010

(30) Foreign Application Priority Data

Mar. 26, 2009 (TW) ..... 98110005 A

(51) Int. Cl.
*G09G 3/36* (2006.01)

(52) U.S. Cl. ..... 345/87; 345/204

(58) Field of Classification Search ..... 345/204, 345/87–103, 212–213
See application file for complete search history.

(56) References Cited

U.S. PATENT DOCUMENTS

| | | | | |
|---|---|---|---|---|
| 7,256,761 | B2 | 8/2007 | Huang et al. | |
| 2007/0159441 | A1 * | 7/2007 | Yang et al. | 345/99 |
| 2007/0229433 | A1 * | 10/2007 | Jang | 345/96 |
| 2008/0100558 | A1 * | 5/2008 | Yu | 345/100 |
| 2008/0117158 | A1 * | 5/2008 | Kim et al. | 345/99 |
| 2009/0109197 | A1 * | 4/2009 | Tu et al. | 345/204 |
| 2009/0219242 | A1 * | 9/2009 | Fuchigami et al. | 345/100 |

* cited by examiner

*Primary Examiner* — Alexander S Beck
*Assistant Examiner* — Charles Zheng
(74) *Attorney, Agent, or Firm* — Jianq Chyun IP Office

(57) ABSTRACT

A device for tuning an output enable signal and a method thereof are provided. In the method, a first scan signal and a second scan signal are filtered out according to a duty cycle of the output enable signal, so as to provide a first output scan signal and a second output scan signal. The duty cycle of the output enable signal is increased when a voltage level of the second output scan signal is converted from a disable state to an enable state before a voltage level of the first output scan signal is converted from an enable state to a disable state. Thereby, a rewriting problem is avoided.

4 Claims, 10 Drawing Sheets

DEVICE FOR TUNING OUTPUT ENABLE SIGNAL OF LIQUID CRYSTAL DISPLAY

CROSS-REFERENCE TO RELATED APPLICATION

This application claims the priority benefit of Taiwan application serial no. 98110005, filed Mar. 26, 2009. The entirety of the above-mentioned patent application is hereby incorporated by reference herein and made a part of this specification.

BACKGROUND OF THE INVENTION

1. Field of the Invention

The present invention is related to the technology of tuning an output enable signal, and more particularly adapted for tuning the output enable signal of a gate driver.

2. Description of Related Art

Because of the advantages of low power consumption, no radiation, and so forth, liquid crystal display (LCD) seems to have become a mainstream among display products. Generally speaking, an LCD basically includes a gate driver, a source driver, and a panel. It is noted that the conventional LCD still face rewriting problem when being driven. Such kind of problem is described in detail below.

FIG. 1 illustrates a conventional rewriting phenomenon. Referring to FIG. 1, Signal G1_output is an output scan signal which the gate driver provides to a first scan line, wherein the first scan line is coupled to pixel transistors of a first-row. Signal G2_output is an output scan signal which the gate driver provides to a second scan line, wherein the second scan line is coupled to pixel transistors of a second-row. Signal S2_output is a data signal which the source driver provides to pixel transistors of the second-row.

In an ideal condition, the time for Signal G1_output and Signal G2_output to drop from high voltage to low voltage is about 0 second. Likewise, the time for rising from low voltage to high voltage is about 0 second as well, as indicated by the dotted line in FIG. 1. However, in actual situation, the voltages of Signal G1_output and Signal G2_output do not form perfect rectangular waveforms. Delay occurs when the voltages drop from high voltage to low voltage or rise from low voltage to high voltage, as illustrated by the solid line in FIG. 1.

Referring to FIG. 1, a turn-on voltage of a pixel transistor is assumed to be Vth. At Time T1, pixel transistors of the first-row pixel are changed from turn-on status to turn-off status. Moreover, at Time T2, pixel transistors of the second-row are changed from turn-off status to turn-on status. That is, in the time period between Time T1 and T2, pixel transistors of the first-row and pixel transistors of the second-row are turned on together. Hence, Signal S2_output simultaneously performs writing on pixel transistors of the first-row and the second-row in the period between Time T1 and T2, which is called rewriting phenomenon. However, in an ideal condition, Signal S2_output should perform writing only on pixel transistors of the second-row.

SUMMARY OF THE INVENTION

The present invention provides a device for tuning an output enable signal, which prevents rewriting problem.

The present invention provides a method of tuning an output enable signal for compliantly adjusting a duty cycle of the output enable signal.

The present invention provides a device for tuning an output enable signal, and the tuning device includes a filter circuit, a first detecting unit, a second detecting unit, and a tuning unit. The filter circuit filters out a first scan signal and a second scan signal according to a duty cycle of the output enable signal, thereby outputting a first output scan signal and a second output scan signal, wherein a scan sequence of the second scan signal follows a scan sequence of the first scan signal. The first detecting unit is coupled to the filter circuit and detects whether a voltage of the first output scan signal is smaller than a predetermined voltage, thereby outputting a first detection result, wherein the predetermined voltage indicates a turn-on voltage of a pixel transistor. The second detecting unit is coupled to the first detecting unit and detects whether an indication signal is received before the voltage of the first scan signal becomes smaller than the turn-on voltage based on the first detection result, thereby outputting a second detection result, wherein the indication signal indicates whether the voltage of the second scan signal increases. The tuning unit is coupled to the second detecting unit for receiving the second detection result. If the second detecting unit receives the indication signal before the voltage of the first output scan signal becomes smaller than the turn-on voltage, the duty cycle of the output enable signal is increased.

In an embodiment of the present invention, the first detecting unit includes a differential amplifier. A positive input terminal and a negative input terminal of the differential amplifier respectively receive the predetermined voltage and the first output scan signal. An output terminal of the differential amplifier outputs the first detection result.

In an embodiment of the present invention, the second detecting unit includes an SR flip-flop, an N channel transistor, and a P channel transistor. A setting terminal of the SR flip-flop receives the indication signal. A reset terminal of the SR flip-flop is coupled to the output terminal of the differential amplifier. A gate terminal of the N channel transistor is coupled to the output terminal of the differential amplifier. A first terminal of the N channel transistor is coupled to a ground voltage. A second terminal of the N channel transistor provides the second detection result. A gate terminal of the P channel transistor is coupled to the output terminal of the differential amplifier. A first terminal of the P channel transistor is coupled to the output terminal of the SR flip-flop. A second terminal of the P channel transistor is coupled to the second terminal of the N channel transistor.

In an embodiment of the present invention, the duty cycle of the output enable signal is maintained if the second detecting unit does not receive the indication signal before the voltage of the first scan signal becomes smaller than the turn-on voltage.

From another perspective, the present invention provides a method for tuning an output enable signal, and the method includes filtering out a first scan signal and a second scan signal according to a duty cycle of the output enable signal, thereby providing a first output scan signal and a second output scan signal, wherein a scan sequence of the second scan signal follows a scan sequence of the first scan signal. The tuning method further includes detecting whether the voltage level of the second output scan signal is converted from a disable state to an enable state before the voltage level of the first output scan signal is converted from an enable state to a disable state. Moreover, the duty cycle of the output enable signal is increased if the voltage level of the second output scan signal is converted from the disable state to the enable state before the voltage level of the first output scan signal is converted from the enable state to the disable state.

Based on the above, the present invention includes filtering out the first scan signal and the second scan signal according to the duty cycle of the output enable signal, thereby providing the first output scan signal and the second output scan signal. If the voltage level of the second output scan signal is converted from the disable state to the enable state before the voltage level of the first output scan signal is converted from the enable state to the disable state, the duty cycle of the output enable signal is increased. As a consequence, the problem of rewriting can be avoided.

To make the above features and advantages of the present invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
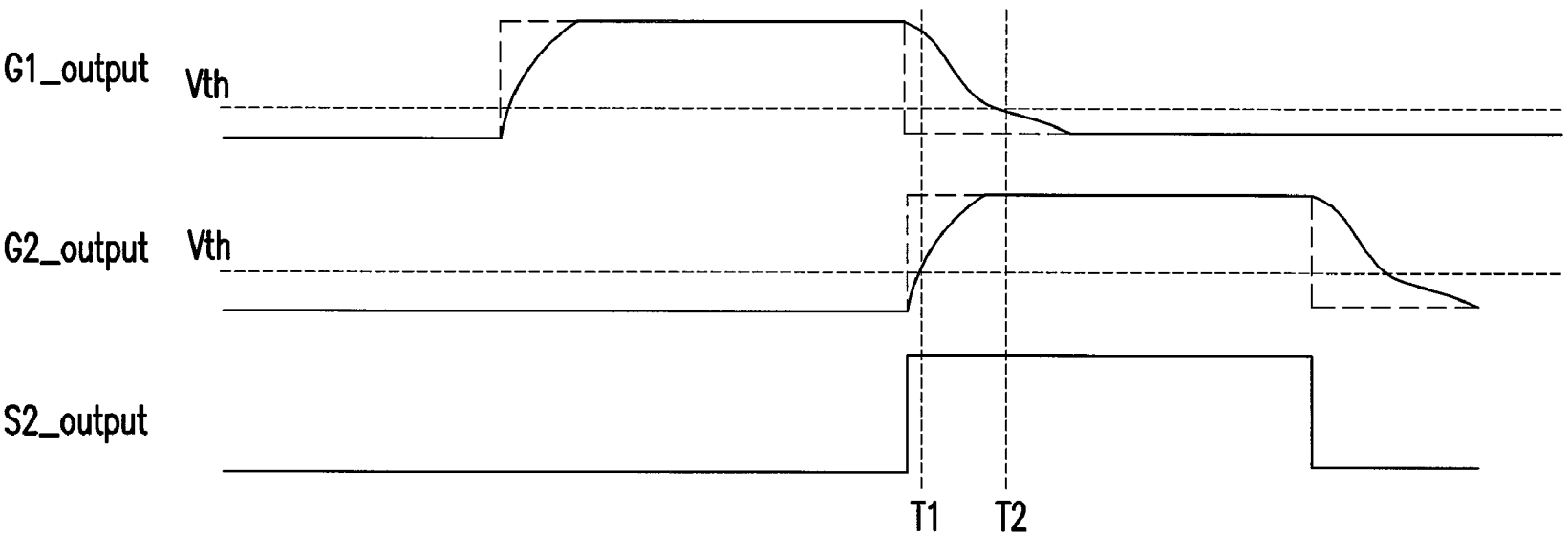
FIG. 1 (PRIOR ART)
FIG. 1 shows a conventional rewriting phenomenon.

Conventional LCDs have rewriting problem. In the embodiments of the present invention, a first scan signal and a second scan signal are filtered out based on a duty cycle of an output enable signal, thereby outputting a first output scan signal and a second output scan signal, so as to overcome the rewriting problem. Hence, the overlap of the first output scan signal and the second output scan signal can be effectively prevented.

Moreover, the output enable signals of different LCDs may have different optimal duty cycles. For reasons like this, the embodiments of the present invention are directed to detecting whether a voltage level of the second output scan signal is converted from a disable state to an enable state before a voltage level of the first output scan signal is converted from the enable state to the disable state. The duty cycle of the output enable signal is increased if the voltage level of the second output scan signal is converted from the disable state to the enable state before the voltage level of the first output scan signal is converted from the enable state to the disable state. However, if the voltage level of the second output scan signal is not converted from the disable state to the enable state before the voltage level of the first output scan signal is converted from the enable state to the disable state, the duty cycle of the output enable signal is maintained. Based on the above, the duty cycle of the output enable signal can be tuned compliantly. With reference to the drawings, the following paragraphs give detailed descriptions of the embodiments of the present invention. The drawings are illustration of the exemplary embodiments of the present invention, wherein identical or similar steps are indicated by the same reference numerals.

Figure 2:
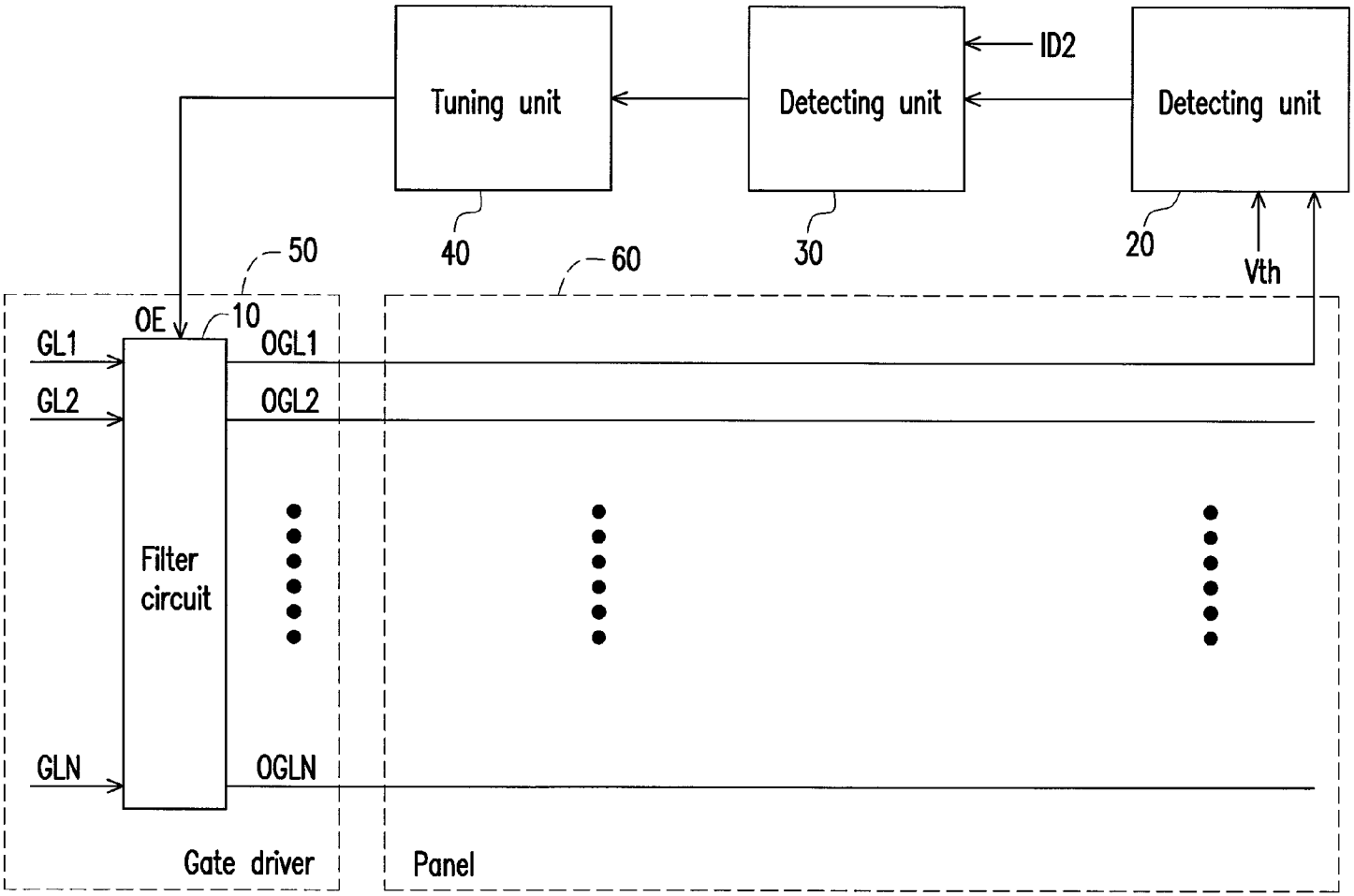
FIG. 2 is a schematic view of a device for tuning an output enable signal according to one embodiment of the present invention.

FIG. 2 is a schematic view of a device for tuning an output enable signal according to one embodiment of the present invention. Referring to FIG. 2, an LCD is described as an example in this embodiment. The tuning device is adapted for a gate driver 50 of the LCD. More specifically, a portion of the elements of the tuning device can be integrated with the gate driver 50. The tuning device includes a filter circuit 10, a detecting unit 20, a detecting unit 30, and a tuning unit 40.

Figure 3:
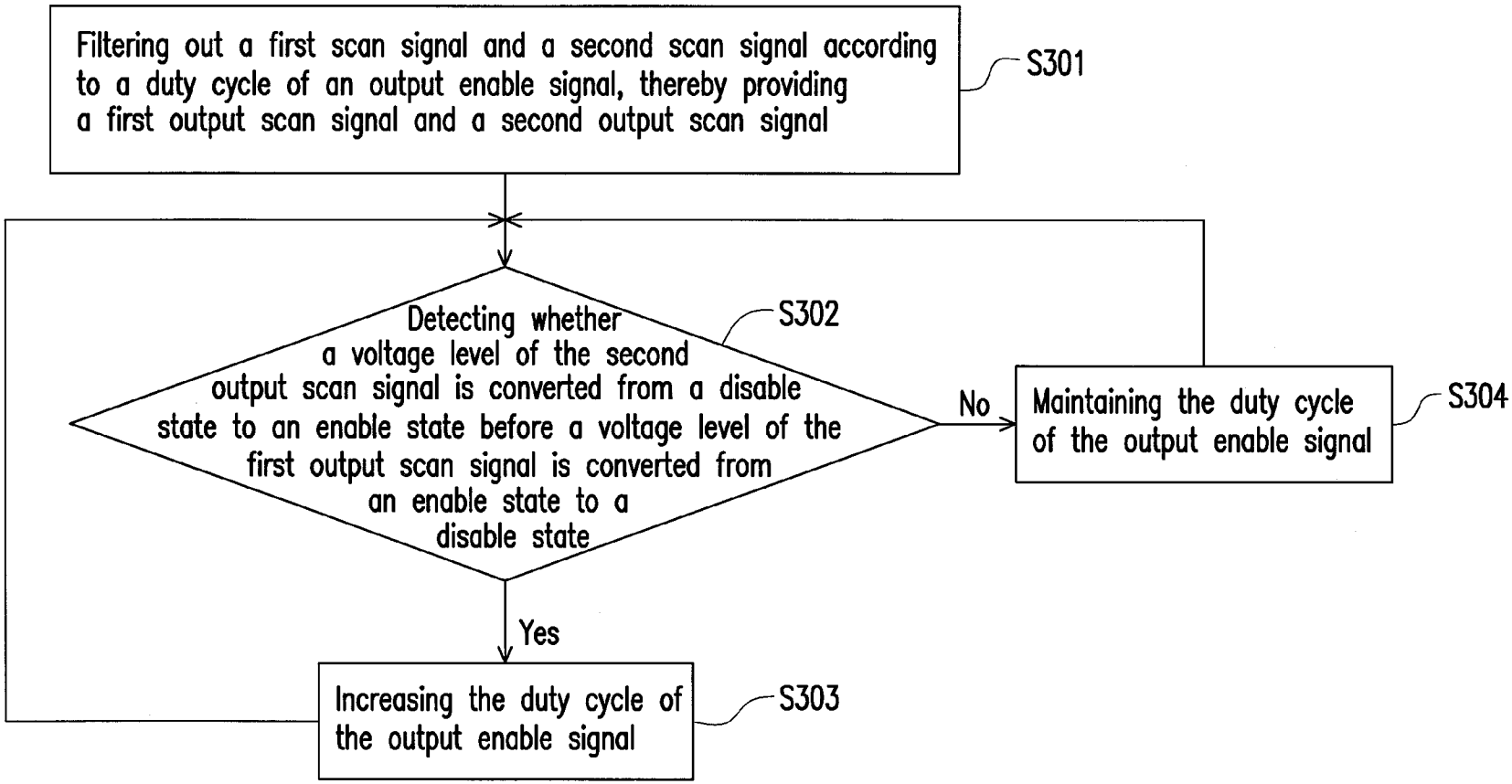
FIG. 3 is a flowchart showing a method for tuning an output enable signal according to one embodiment of the present invention.

FIG. 3 is a flowchart showing a method for tuning an output enable signal according to one embodiment of the present invention. Referring to both FIG. 2 and FIG. 3, the filter circuit 10 receives an output enable signal OE that is provided by the tuning unit 40 and a plurality of scan signals (GL1~GLN) that are sequentially provided by a plurality of shift registers (not shown). Next, in Step S301, the filter circuit 10 filters out the plurality of scan signals (GL1~GLN) based on a duty cycle D of the output enable signal OE, thereby providing a plurality of output scan signals (OGL1~OGLN) in sequence to pixel transistors of each row (not shown) of a panel 60. Detailed explanations are given below.

TABLE 1

Truth table of the filter circuit 10

| Scan signal | Output enable signal | Output scan signal |
|---|---|---|
| High voltage level (1) | High voltage level (1) | Low voltage level (0) |
| High voltage level (1) | Low voltage level (0) | High voltage level (1) |
| Low voltage level (0) | High voltage level (1) | Low voltage level (0) |
| Low voltage level (0) | Low voltage level (0) | Low voltage level (0) |

Figure 4:
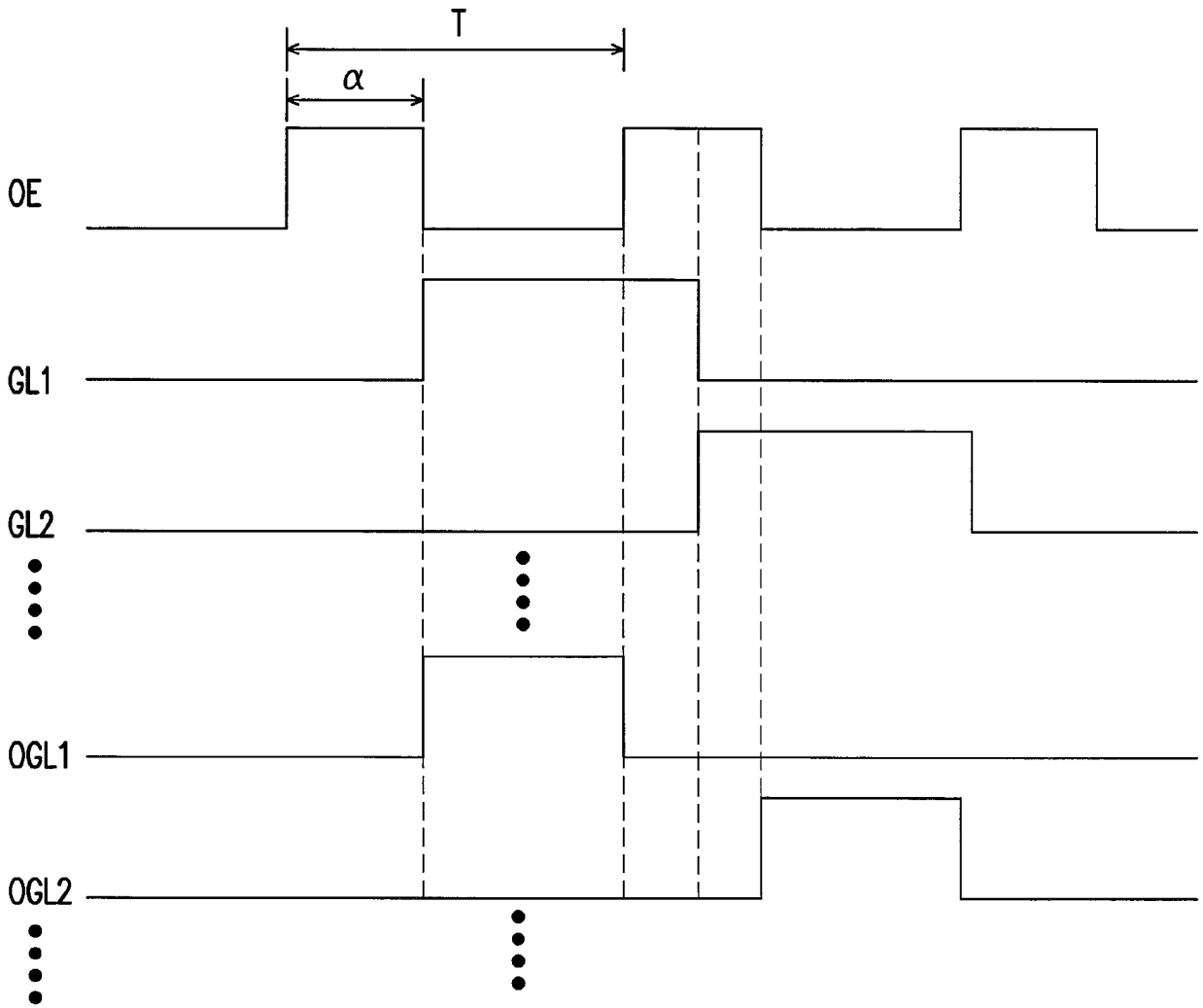
FIG. 4 is a schematic diagram of filtering out an output scan signal based on an output enable signal according to one embodiment of the present invention.

FIG. 4 is a schematic diagram of filtering out an output scan signal based on an output enable signal according to one embodiment of the present invention. Referring to FIG. 2~FIG. 4 and Table 1, the scan signal GL1 and the output scan signal OGL1 are described as an example in the following paragraphs. When the scan signal GL1 and the output enable signal OE are both in high voltage level, the output scan signal OGL1 is in low voltage level. When the scan signal GL1 is in high voltage level and the output enable signal OE is in low voltage level, the output scan signal OGL1 is in high voltage level. When the scan signal GL1 is in low voltage level and the output enable signal OE is in high voltage level, the output scan signal OGL1 is in low voltage level. When the scan signal GL1 and the output enable signal OE are both in low voltage level, the output scan signal OGL1 is in low voltage level. The voltage levels of the scan signals GL2~GLN and the output scan signals OGL2~OGLN can be deduced based on the above, and therefore not repeatedly described hereinafter.

Based on the aforementioned, when the output enable signal OE is in high voltage level, the output scan signals OGL1~OGLN are in low voltage level. When the output enable signal OE is in low voltage level, the output scan signals OGL1~OGLN are respectively in the same voltage levels as the scan signals GL1~GLN. That is, when two of the scan signals are in high voltage level, the output enable signal OE can be set to high voltage level, so as to avoid the situation that two output scan signals are in high voltage level at the same time. As a consequence, the conventional rewriting problem can be improved. Persons skilled in the art should note that an optimal value of the duty cycle D of the output enable signal OE may differ between LCDs, wherein the duty cycle D is $\alpha/T$. Then, the following Steps S302~S304 are carried out to compliantly tune the duty cycle D of the output enable signal OE.

Step S302 is detecting whether the voltage level of the output scan signal OGL2 is converted from the disable state (low voltage level) to the enable state (high voltage level) before the voltage level of the output scan signal OGL1 is converted from the enable state to the disable state. This step is to judge whether the LCD encounters rewriting problem. In short, if the output scan signal OGL1 and the output scan signal OGL2 are in high voltage level at the same time, which indicates that the LCD has rewriting problem, Step S303 is carried out to increase the duty cycle D of the output enable signal OE for improving the rewriting problem. Otherwise, the LCD has no rewriting problem, and Step S304 is carried out to maintain the output enable signal OE. An implementing method of Step S302 is given as follows for persons skilled in the art.

It should be noted that, a period that the scan signals GL1~GLN are in high voltage level is longer than a period that the output scan signals OGL1~OGLN are in high voltage level. Given that the output enable signal OE is absent, the scan signals GL1~GLN and the output scan signals OGL1~OGLN would be substantially the same.

In this embodiment, the output scan signal OGL1 and an indication signal ID2, which indicates whether the voltage of the scan signal GL2 increases, are the basis for determining whether the LCD has rewriting problem. An advantage of this method lies in that, after Step S303 is carried out to increase the duty cycle D of the output enable signal OE for overcoming the rewriting problem, the period that the output scan signal OGL1 of a following image stays in high voltage level is shorted without affecting the indication signal ID2. Since only one variable exists, the complexity of implementing the method is simplified, and the occurrence of error is reduced. The feature "determining whether the LCD has rewriting problem based on the output scan signal OGL1 and the indication signal ID2, which indicates whether the voltage of the scan signal GL2 increases" is further explained as follows.

Figure 5:
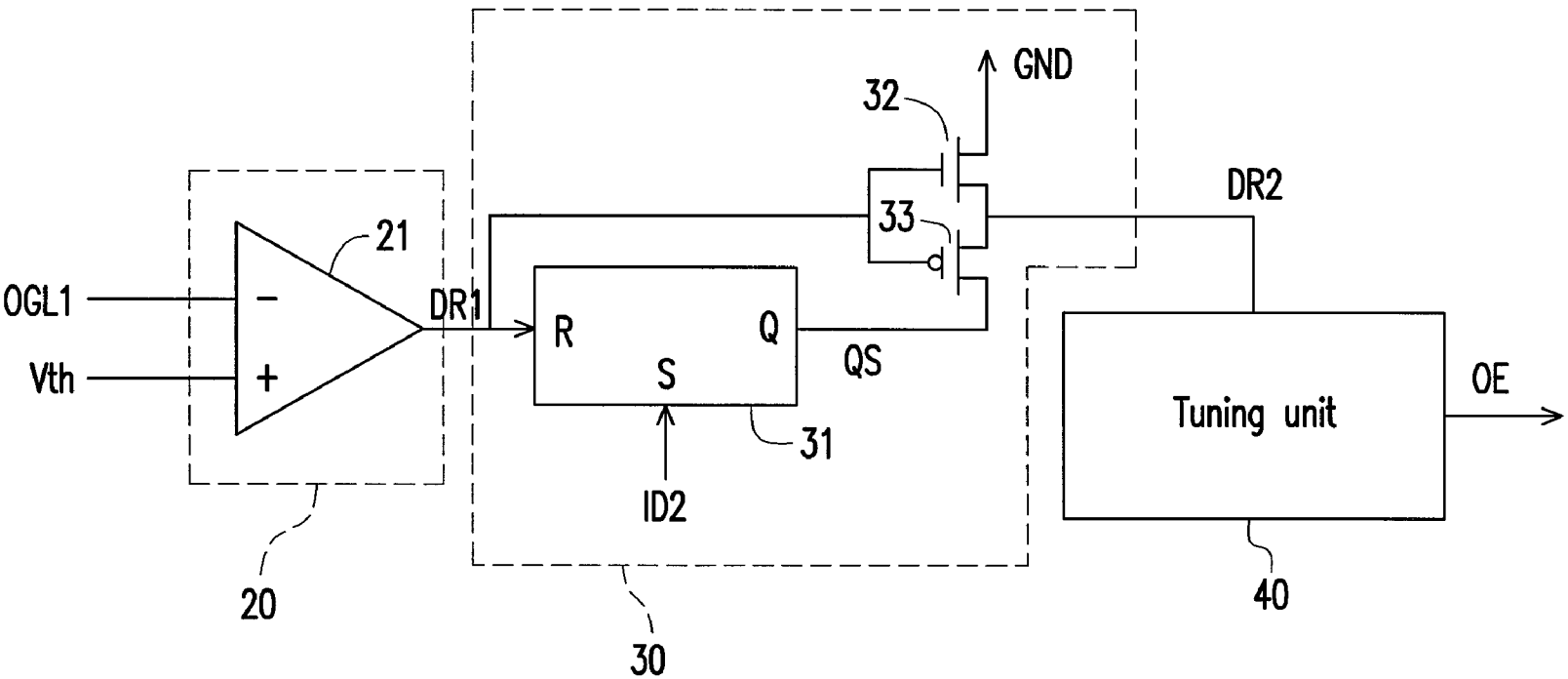
FIG. 5 is a circuit diagram of a detecting unit of a tuning device according to one embodiment of the present invention.

FIG. 5 is a circuit diagram of a detecting unit of a tuning device according to one embodiment of the present invention. With reference to FIG. 2, FIG. 3, and FIG. 5, in this embodiment, the detecting unit 20 is, for example, a differential amplifier 21. The detecting unit 30 is, for example, an SR flip-flop 31, an N channel transistor 32, and a P channel transistor 33.

The differential amplifier 21 includes a positive input terminal and a negative input terminal. The positive input terminal of the differential amplifier 21 is coupled to a first scan line, wherein the first scan line is coupled to a gate of each pixel transistor of a first-row, and the differential amplifier 21 receives the output scan signal OGL1. The negative input terminal of the differential amplifier 21 receives a predetermined voltage Vth, wherein the predetermined voltage Vth is a turn-on voltage of the aforementioned pixel transistor. In other words, when the voltage of the output scan signal OGL1 is lower than the predetermined voltage Vth, pixel transistors of the first-row are turned off, and an output terminal of the differential amplifier 21 outputs a detection result DR1 of high voltage level. On the contrary, when the voltage of the output scan signal OGL1 is higher than the predetermined voltage Vth, pixel transistors of the first-row are turned on, and the output terminal of the differential amplifier 21 outputs the detection result DR1 of low voltage level.

TABLE 2

Truth table of the SR flip-flop 31

| Reset terminal R | Setting terminal S | Output terminal Q |
|---|---|---|
| Low voltage level (0) | Low voltage level (0) | Maintained as the previous state |
| Low voltage level (0) | High voltage level (1) | Set to high voltage level (1) |
| High voltage level (1) | Low voltage level (0) | Reset to low voltage level (0) |
| High voltage level (1) | High voltage level (1) | X |

With reference to Table 2, the SR flip-flop 31 includes the reset terminal R, the setting terminal S, and the output terminal Q. The reset terminal R of the SR flip-flop 31 receives the detection result DR1. The setting terminal S of the SR flip-flop 31 receives the indication signal ID2. In this embodiment, the indication signal ID2 is, for example, a pulse width signal. The SR flip-flop 31 provides a signal QS from the output terminal Q to a second terminal of a transistor 33, based on the above Table 2.

In this embodiment, transistors 32 and 33 and the filter circuit 10 have similar functions. Gates of the transistors 32 and 33 receive the detection result DR1, which determines whether to turn on or not. In other words, the transistors 32 and 33 output a ground voltage GND or the signal QS based on the detection result DR1, thereby providing a detection result DR2 to the tuning unit 40. To be more specific, when the detection result DR1 is in high voltage level, the detection result DR2 and the ground voltage GND have the same voltage level. When the detection result DR1 is in low voltage level, the detection result DR2 and the signal QS have the same voltage level. From another perspective, the detection result DR2 being in high voltage level indicates that the LCD has rewriting problem. An implementing method of Steps S303 and S304 is given as follows for reference of persons skilled in the art.

Figure 6:
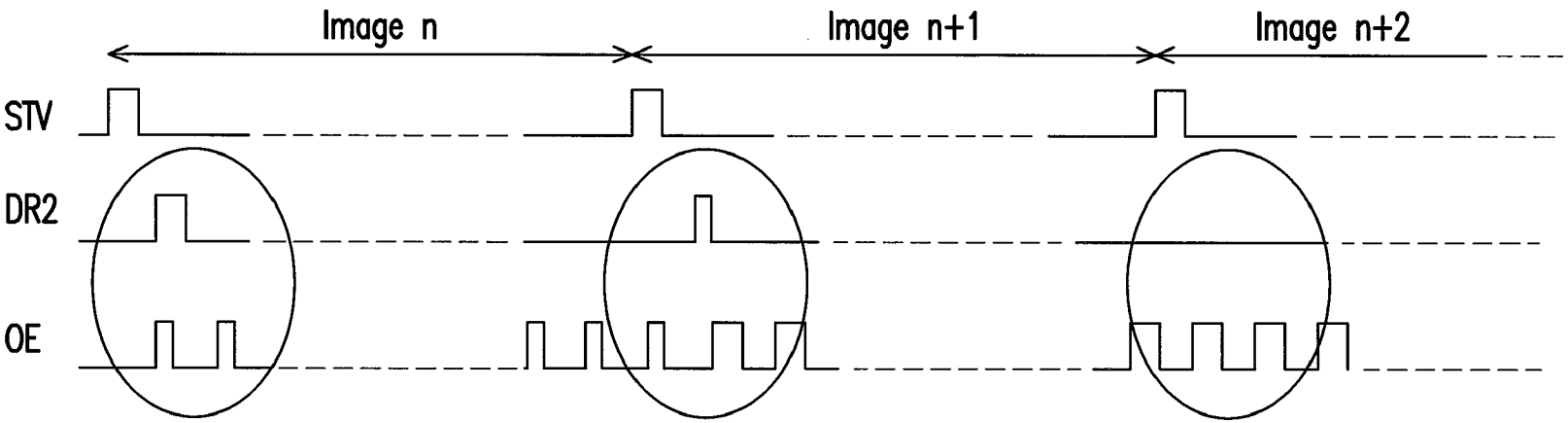
FIG. 6 is a schematic diagram of tuning an output enable signal according to one embodiment of the present invention.

FIG. 6 is a schematic diagram of tuning an output enable signal according to one embodiment of the present invention. Referring to FIG. 6, a signal STV separates different frame periods. The tuning unit 40 determines whether to carry out Step S303 or Step S304 based on the detection result DR2 obtained in Step S302. That is to say, the tuning unit 40 decides whether to increase or maintain the duty cycle D of the output enable signal OE based on the voltage level of the detection result DR2. In each frame period, for instance, when the tuning unit 40 receives the detection result DR2 that is in high voltage level, Step S303 is carried out to add one unit to the duty cycle D of the output enable signal OE. On the contrary, when the tuning unit 40 receives the detection result DR2 that is in low voltage level, Step S304 is carried out to maintain the duty cycle D of the output enable signal OE. Based on the above, the duty cycle D of the output enable signal OE can be tuned compliantly. Various situations that occur during the operations of the LCD are further described in the following paragraphs.

Figure 7:
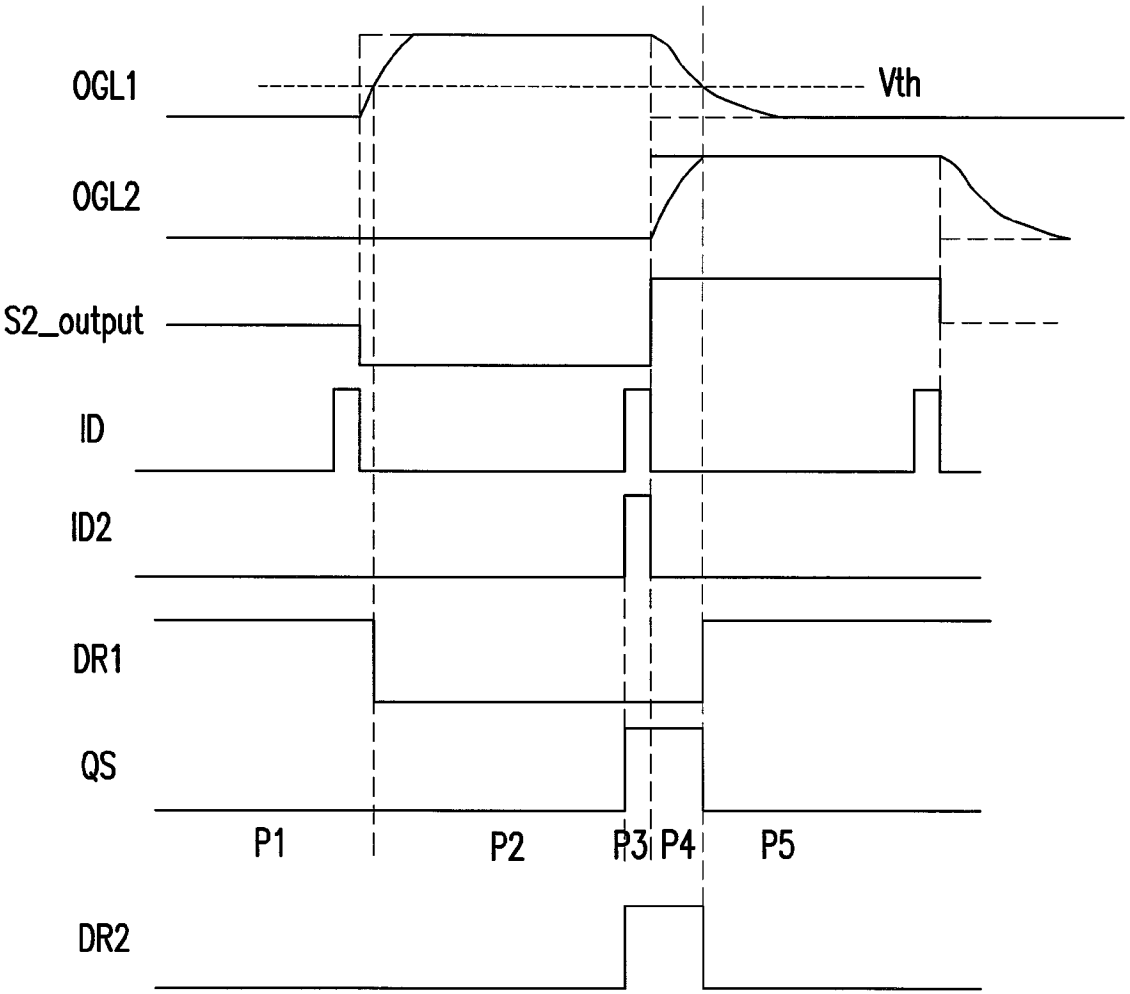
FIG. 7 is a diagram showing a waveform of each signal when a duty cycle of an output enable signal is severely insufficient.

FIG. 7 is a diagram showing a waveform of each signal when the duty cycle of the output enable signal is severely insufficient. With reference to FIG. 2, FIG. 5, FIG. 7, and Table 3, when the duty cycle D of the output enable signal OE is severely insufficient, the output scan signals OGL1 and OGL2 overlap with each other when being in high voltage level. In other words, a source driver starts outputting a signal S2_output to pixel transistors of a second-row before the voltage of the output scan signal OGL1 drops. Therefore, the signal S2_output is written into pixel transistors of the first-row and the second-row, resulting in the rewriting phenomenon. In FIG. 7, the indication signal ID2 is generated based on the indication signal ID, wherein the indication signal ID is used for indicating the increase of the voltage of the scan signal. According to the disclosure of the above embodiments, the tuning device detects the output scan signal OGL1 and the indication signal ID2, and thereby generates the detection result DR2 of high voltage level. Following that, the duty cycle D of the output enable signal OE is increased based on the detection result DR2, so as to improve the rewriting phenomenon. After the duty cycle D of the output enable signal OE is increased, the period that the output scan signals OGL1~OGLN of the following image remain in high voltage level is shorted accordingly.

TABLE 3

| Output status of the SR flip-flop 31 in each period according to FIG. 7 | |
|---|---|
| Period P1 | Reset to low voltage level (0) |
| Period P2 | Maintained as the previous state |
| Period P3 | Reset to high voltage level (1) |
| Period P4 | Maintained as the previous state |
| Period P5 | Reset to low voltage level (0) |

Figure 8:
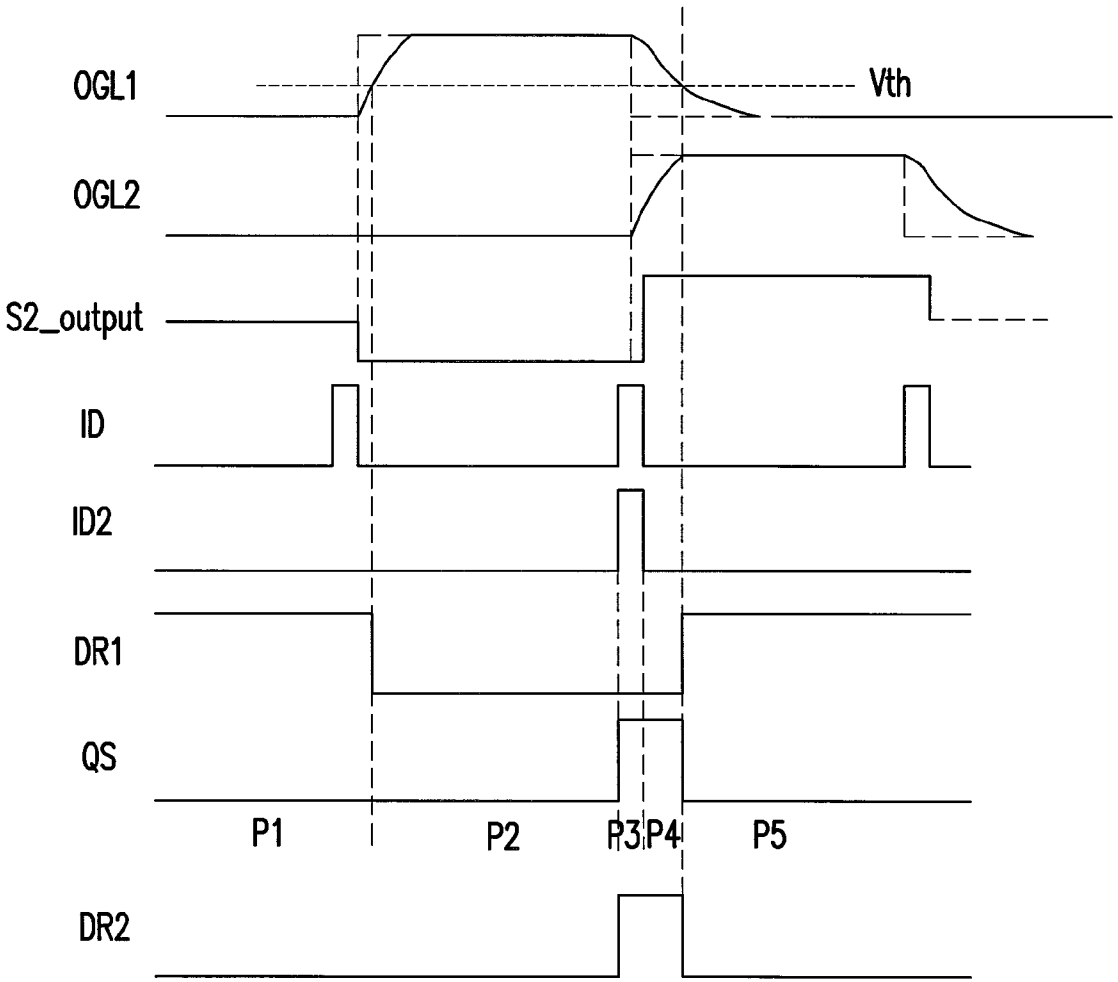
FIG. 8 is a diagram showing a waveform of each signal when a duty cycle of an output enable signal is insufficient.

FIG. 8 is a diagram showing a waveform of each signal when the duty cycle D of the output enable signal is insufficient. Please refer to FIG. 2, FIG. 5, FIG. 8, and Table 4. In FIG. 8, the source driver starts outputting the signal S2_output to pixel transistors of the second-row before the voltage of the output scan signal OGL1 drops to the predetermined voltage Vth. Therefore, the signal S2_output is written into pixel transistors of the first-row and the second-row, resulting in the rewriting phenomenon. It should be noted that, the tuning device 40 can detect the output scan signal OGL1 and the indication signal ID2, and thereby generate the detection result DR2 that is in high voltage level. Following that, the duty cycle D of the output enable signal OE is increased based on the detection result DR2, so as to improve the rewriting phenomenon. After the duty cycle D of the output enable signal OE is increased, the period that the output scan signals OGL1~OGLN of the following image remain in high voltage level is shorted accordingly.

TABLE 4

| Output status of the SR flip-flop 31 in each period according to FIG. 8 | |
|---|---|
| Period P1 | Reset to low voltage level (0) |
| Period P2 | Maintained as the previous state |
| Period P3 | Reset to low voltage level (0) |
| Period P4 | X |
| Period P5 | Reset to low voltage level (0) |

Figure 9:
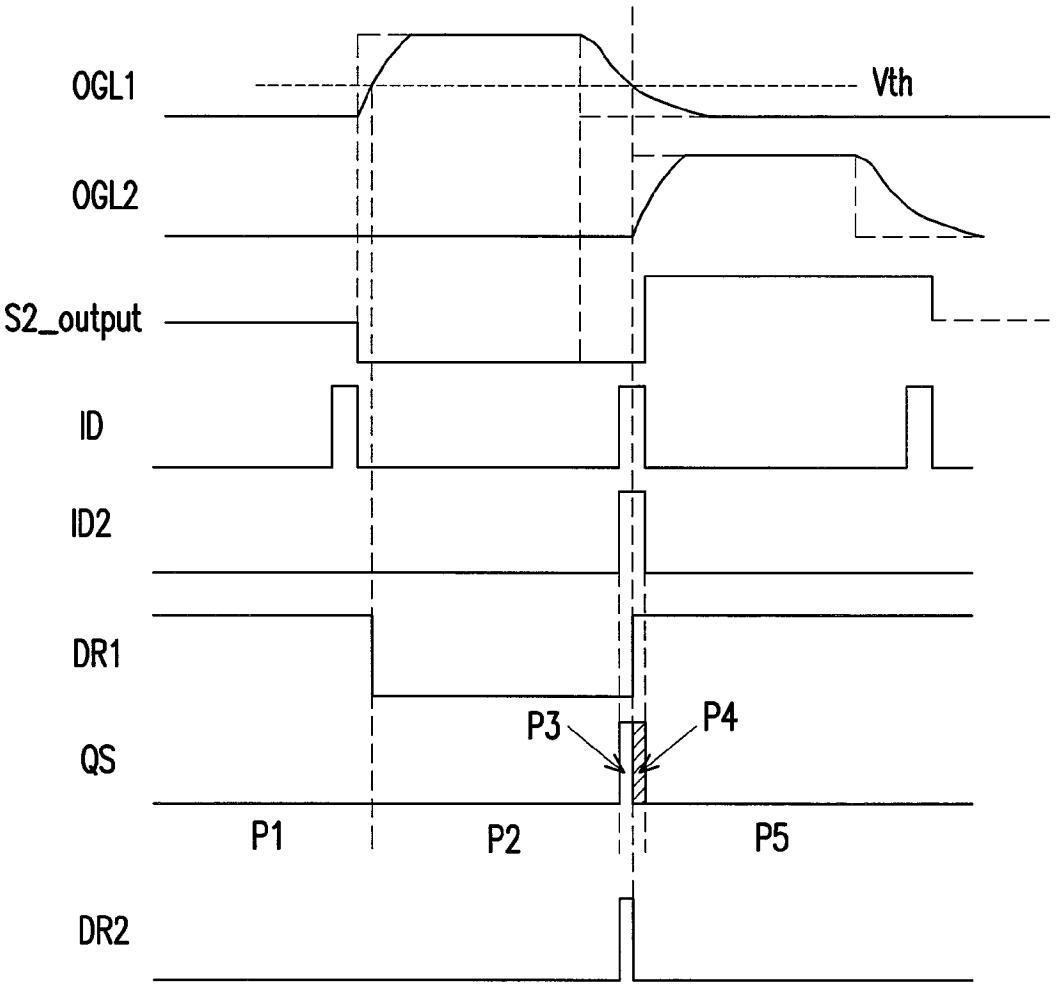
FIG. 9 is a diagram showing a waveform of each signal when a duty cycle of an output enable signal is slightly insufficient.

FIG. 9 is a diagram showing a waveform of each signal when the duty cycle of the output enable signal is slightly insufficient. Please refer to FIG. 2, FIG. 5, FIG. 9, and Table 5. In FIG. 9, the output scan signals OGL1 and OGL2 do not overlap with each other (in a critical state) when being in high voltage level. However, according to this embodiment, the tuning device 40 is to detect the output scan signal OGL1 and the indication signal ID2, and thereby generate the detection result DR2 that is in high voltage level. In the critical state, the tuning device 40 would determine that the LCD has rewriting phenomenon and generate the detection result DR2 of high voltage level for increasing the duty cycle D of the output enable signal OE. The advantage of this method lies in that the rewriting phenomenon can be completely eliminated. After the duty cycle D of the output enable signal OE is increased, the period that the output scan signals OGL1~OGLN of the succeeding image remain in high voltage level is shorted accordingly.

TABLE 5

| Output status of the SR flip-flop 31 in each period according to FIG. 9 | |
|---|---|
| Period P1 | Reset to low voltage level (0) |
| Period P2 | Maintained as the previous state |
| Period P3 | Reset to high voltage level (1) |
| Period P4 | X |
| Period P5 | Reset to low voltage level (0) |

Figure 10:
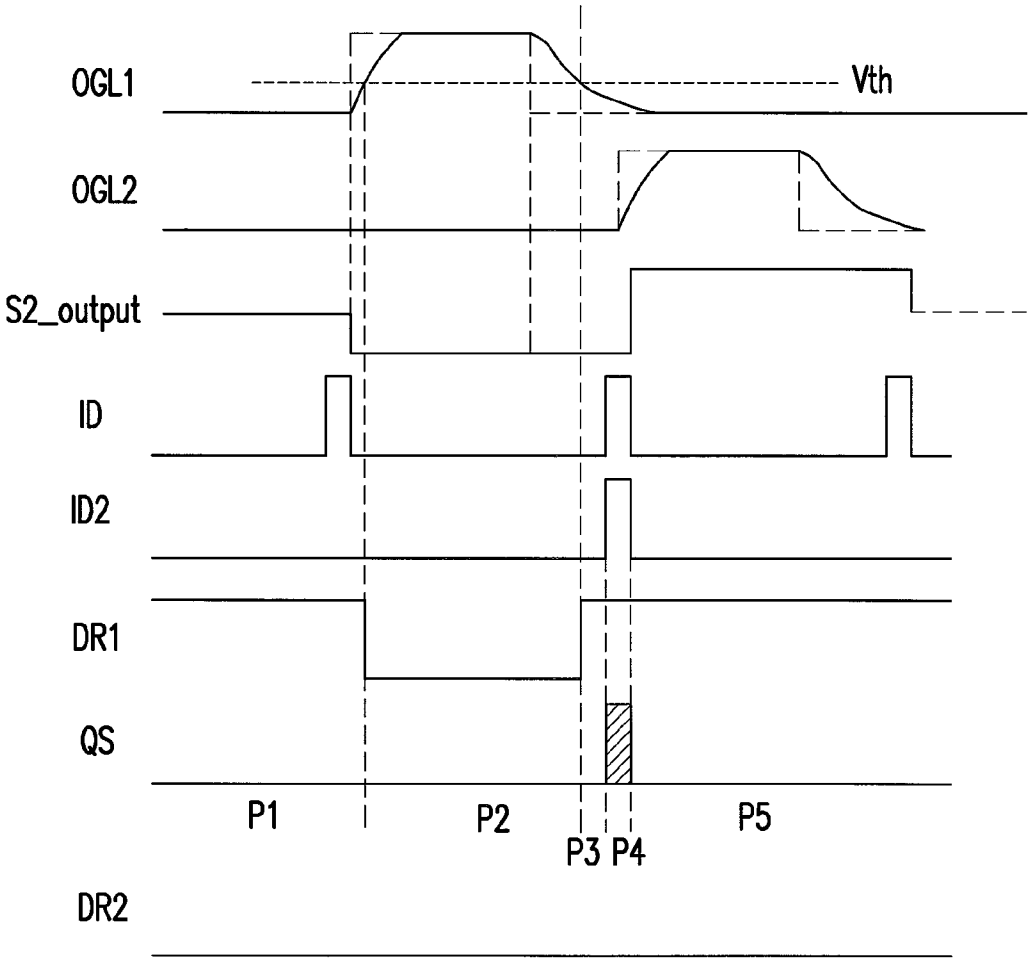
FIG. 10 is a diagram showing a waveform of each signal when a duty cycle of an output enable signal is sufficient.

FIG. 10 is a diagram showing a waveform of each signal when the duty cycle of the output enable signal is sufficient. Please refer to FIG. 2, FIG. 5, FIG. 10, and Table 6. In FIG. 10, the output scan signals OGL1 and OGL2 do not overlap with each other and are separated by a period when being in high voltage level. Accordingly, the tuning device 40 generates the detection result DR2 that is in low voltage level for maintaining the duty cycle D of the output enable signal OE. Consequently, the LCD can have favorable image quality and the rewriting phenomenon can be effectively eliminated.

TABLE 6

| Output status of the SR flip-flop 31 in each period according to FIG. 10 | |
|---|---|
| Period P1 | Reset to low voltage level (0) |
| Period P2 | Maintained as the previous state |
| Period P3 | Reset to low voltage level (0) |
| Period P4 | X |
| Period P5 | Reset to low voltage level (0) |

Although the above-described embodiments have depicted a possible type of the device for tuning output enable signal and the method thereof, it is common sense to persons having ordinary knowledge in the art that different manufacturers may develop different designs of tuning devices and methods, and thus the application of the present invention should not be limited to this type only. In other words, any contents related to determining whether the LCD has rewriting problem and thereby increasing or maintaining the duty cycle D of the output enable signal are deemed to have conformed to the essence of the present invention. The following further provides some other embodiments to allow persons having ordinary knowledge in the art to understand the spirit of the present invention and implement the present invention.

In the above embodiments, the output scan signal OGL1 and the indication signal ID2, which indicates whether the voltage of the scan signal GL2 increases, are the basis for determining whether the LCD has rewriting problem. However, the present invention is not limited thereto. In other embodiments, the output scan signal OGL1 and the output scan signal OGL2 can be based on to judge whether the LCD has rewriting problem. The advantage lies in that, as long as the output scan signal OGL1 and the output scan signal OGL2 do not overlap during the period of high voltage level, the tuning device 40 would not increase the duty cycle D of the output enable signal OE.

Moreover, the above embodiments describe that the tuning unit 40 adds one unit to the duty cycle D of the output enable signal OE in Step S303. It is noted that the addition of one unit is only one of the options. In other embodiments, the tuning unit 40 can also adjust the duty cycle D of the output enable signal OE according to the pulse width of the detection result DR2. The foregoing is advantageous to obtaining an appropriate duty cycle D of the output enable signal OE more quickly.

In conclusion of the above, the present invention can be adopted to determine whether an LCD has rewriting phenomenon and thereby decide whether to increase or maintain the duty cycle of the output enable signal. Consequently, the rewriting phenomenon can be improved, and the duty cycle of the output enable signal can be tuned compliantly. The embodiments of the present invention further produce the following effects:

1. The output scan signal OGL1 and the indication signal ID2, which indicates whether the voltage of the scan signal GL2 increases, can be based on to determine whether the LCD has rewriting problem. The rewriting phenomenon can be completely eliminated.

2. The output scan signal OGL1 and the output scan signal OGL2 can be based on to determine whether the LCD has rewriting problem. The aforementioned has an advantage that, as long as the output scan signal OGL1 and the output scan signal OGL2 do not overlap during the period of high voltage level, the tuning device does not increase the duty cycle of the output enable signal OE.

3. The duty cycle of the output enable signal OE can be adjusted and tuned based on the pulse width of the detection result DR2. An appropriate duty cycle of the output enable signal OE can be quickly obtained.

Although the present invention has been described with reference to the above embodiments, it will be apparent to one of the ordinary skill in the art that modifications to the described embodiments may be made without departing from the spirit of the invention. Accordingly, the scope of the invention is defined by the attached claims not by the above detailed descriptions.

What is claimed is:

1. A device for tuning an output enable signal, comprising:

a filter circuit, filtering out a first scan signal and a second scan signal based on a duty cycle of the output enable signal, thereby providing a first output scan signal and a second output scan signal, wherein a scan sequence of the second scan signal follows a scan sequence of the first scan signal;

a first detecting unit, coupled to the filter circuit and detecting whether the voltage of the first output scan signal is smaller than a predetermined voltage, thereby outputting a first detection result, wherein the predetermined voltage indicates a turn-on voltage of a pixel transistor;

a second detecting unit, coupled to the first detecting unit and detecting whether an indication signal is received before the voltage of the first output scan signal becomes smaller than the turn-on voltage based on the first detection result, thereby outputting a second detection result, wherein the indication signal indicates whether the voltage of the second scan signal increases; and a tuning unit, coupled to the second detecting unit and receiving the second detection result, and the tuning unit increasing the duty cycle of the output enable signal if the second detecting unit receives the indication signal before the voltage of the first output scan signal becomes smaller than the turn-on voltage.

2. The tuning device as claimed in claim 1, wherein the first detecting unit comprises:

a differential amplifier, having a positive input terminal and a negative input terminal respectively used for receiving the predetermined voltage and the first output scan signal, and an output terminal of the differential amplifier outputting the first detection result.

3. The tuning device as claimed in claim 2, wherein the second detecting unit comprises:

an SR flip-flop, having a setting terminal for receiving the indication signal and a reset terminal of said SR flip-flop coupled to the output terminal of the differential amplifier;

an N channel transistor, having a gate terminal coupled to the output terminal of the differential amplifier, a first terminal of said N channel transistor coupled to a ground voltage, and a second terminal of said N channel transistor providing the second detection result; and a P channel transistor, having a gate terminal coupled to the output terminal of the differential amplifier, a first terminal of said P channel transistor coupled to the output terminal of said SR flip-flop, and a second terminal of said P channel transistor coupled to the second terminal of the N channel transistor.

4. The tuning device as claimed in claim 1, wherein the duty cycle of the output enable signal is maintained if the second detecting unit does not receive the indication signal before the voltage of the first scan signal becomes smaller than the turn-on voltage.

* * * * *